United States Patent [19]

Tengzelius et al.

[11] Patent Number: 4,585,480

[45] Date of Patent: Apr. 29, 1986

[54] MATERIAL FOR THE POWDER METALLURGICAL MANUFACTURE OF SOFT MAGNETIC COMPONENTS

[75] Inventors: Jan Tengzelius, Viken; Sten-Ake Kvist, Höganäs; Patricia Jansson, Viken, all of Sweden

[73] Assignee: Höganäs AB, Höganäs, Sweden

[21] Appl. No.: 719,554

[22] Filed: Apr. 3, 1985

[30] Foreign Application Priority Data

Apr. 3, 1984 [SE] Sweden ..... 8401824

[51] Int. Cl.[4] ..... B22F 1/00

[52] U.S. Cl. ..... 75/255; 75/123 L; 75/126 Q; 75/251; 148/105; 252/62.51; 419/38; 419/46

[58] Field of Search ..... 148/31.55, 105; 75/123 L, 126 Q, 251, 255; 252/62.51; 419/38, 46

[56] References Cited

U.S. PATENT DOCUMENTS

| | | | |
|---|---|---|---|
| 4,115,158 | 9/1978 | Reen | 419/10 |
| 4,236,945 | 12/1980 | Reen | 419/10 |
| 4,409,041 | 10/1983 | Datta et al. | 75/123 L |
| 4,473,413 | 9/1984 | Nathasingh et al. | 75/126 A |

*Primary Examiner*—Stephen J. Lechert, Jr.

*Attorney, Agent, or Firm*—Burns, Doane, Swecker, Mathis

[57] ABSTRACT

The aforementioned invention comprises an iron based powder mixture with up to 8% silicon, addition of which is in the form of ferrosilicon with a silicon content of approximately 50% and a particle size mainly less than 150 μm.

3 Claims, 1 Drawing Figure

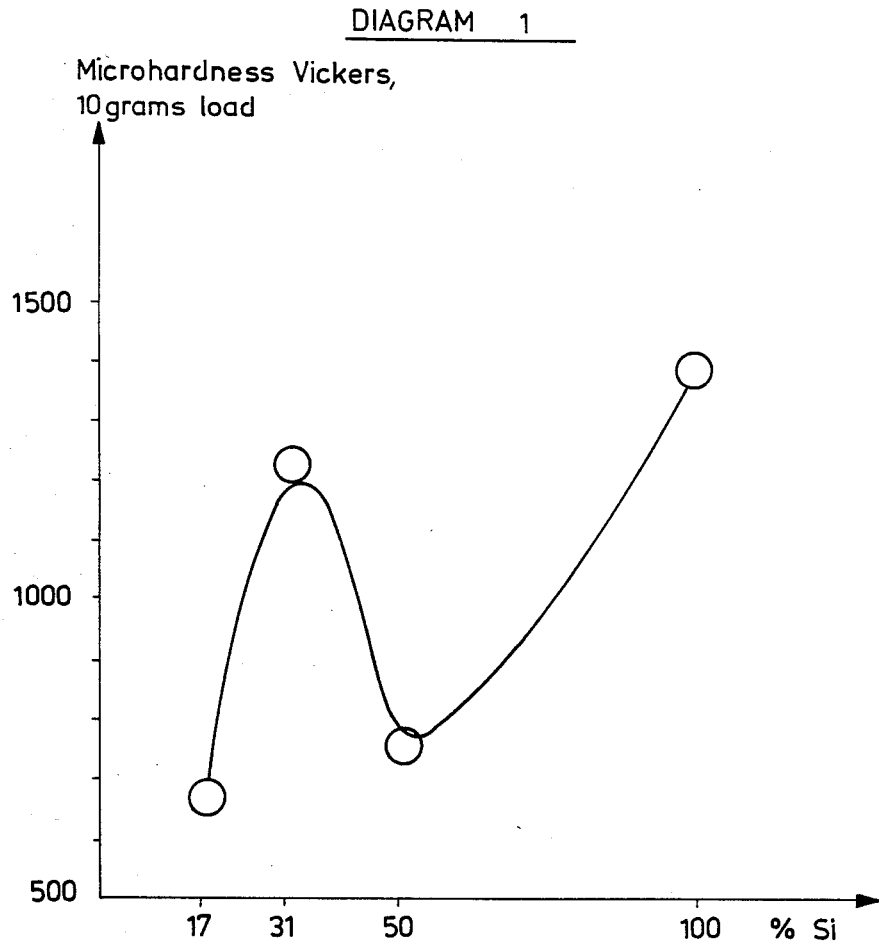
DIAGRAM 1
Microhardness Vickers,
10 grams load
1500
1000
500
17
31
50
100
% Si

MATERIAL FOR THE POWDER METALLURGICAL MANUFACTURE OF SOFT MAGNETIC COMPONENTS

The invention relates to a material for the powder metallurgical manufacture of soft magnetic components, and particularly concerns an iron based silicon powder mixture, especially intended for the powder metallurgical manufacturing of components satisfying demands for good soft magnetic properties and low tool-wear during manufacture.

Powder metallurgical manufacturing techniques are generally characterized by long series production of components having good dimensional accuracy. The manufacturing sequence is generally started by mixing a metallic powder, for example iron powder, if desired containing alloying elements in powder form, with a lubricant in order to simplify a subsequent compression operation. Thereby the powder mixture is compressed to a green component. Thereupon the green compact is heated and is retained at a temperature at which the green compact obtains, by means of sintering, its final characteristics with regard to strength, ductility etc. Basically, materials manufactured in this way differ from materials manufactured by the usual metallurgical method of casting by their porosity. Components satisfying the demands for good soft magnetic properties are usually manufactured from material having iron as its main component. The most common manufacturing method is that wherein the components are manufactured from a piece of highly pure solid material, for example Armco-iron. However, the powder metallurgical technique is also used for the manufacture of such components because of the advantages that this method offers with regard to the saving of material, dimensional accuracy and the simplified shaping of the components. However, it has hitherto not been possible to obtain the same good soft magnetic properties of materials manufactured by means of powder metallurgy including iron as the main component, as for solid material having a corresponding composition. Substantially, this difference is dependent on the porosity of the material manufactured by the powder metallurgical techniques.

Alloying with silicon is a generally accepted method for obtaining improved soft magnetic properties during the manufacture of sheet materials by conventional metallurgical melt techniques.

A related disclosure is the production of silicon alloyed soft magnetic sintered components with silicon additions in the form of ferrosilicon with a silicon content of 31%. Production procedure involves the mixing of ferrosilicon with a pure iron powder to the desired level of silicon, i.e. approx. 3%, followed by compacting and sintering. The production of silicon alloyed powder metallurgical components has not been a commercial success. This is due to the unacceptably high level of tool-wear during the compaction of parts, resulting in the fact that the production of long series is no longer economically feasible.

Accordingly, as has previously been referred to, good soft magnetic properties are dependent on the porosity of the finished component being maintained at a low level. Thus the powder metallurgical manufacturing technique can satisfy this stipulation by employing powder mixes with good compactability at compacting pressures within the normal user area.

The problem which the present invention proposes to solve is to propose a suitable silicon containing alloy addition which combines a reduction of tool-wear during compacting compared with 31% of ferrosilicon with an acceptable compactability for the powder mix. Simultaneously the soft magnetic properties are to be maintained at the same level or improved compared with those obtained with additions of 31% ferrosilicon.

According to the invention the solution is provided by the introduction of ferrosilicon with a silicon content of 45–55%, preferably 50%, and with a particle size mainly less than 100 mesh (147 μm). Through mixing the aforesaid ferrosilicon with a high purity iron powder with a particle size mainly less than 100 mesh (147 μm) to a final silicon content of up to 8%, components can be manufactured by the powder metallurgical process in long series with an acceptable level of tool-wear and good magnetic properties.

The invention is hereinafter described with reference to the following specific examples.

EXAMPLE 1

Three atomised ferrosilicon powders with 17, 31 and 50% Si and ground silicon metal were compared with regard to microhardness. The results of this comparison can be seen in diagram 1.

As can be seen from these results 50% ferrosilicon has a decidedly lower microhardness than 31% ferrosilicon and pure silicon metal. It is known that during the manufacture of powder metallurgical components the presence of powder formed alloying additions during compacting with a microhardness of more than a Vickers hardness of approx. 1000 units, measured at 10 grams results in very pronounced tool-wear.

As presented in diagram 1 the microhardness of 50% ferrosilicon is comparable to that of 17% ferrosilicon. The disadvantage of 17% ferrosilicon additions lies in the reduced compactability of powder mixes containing 17% ferrosilicon compared to those where 50% ferrosilicon has been admixed, the following exemplifies this statement.

EXAMPLE 2

Two powder mixtures with the following compositions are designated A and B.

Material A: 4.0% Si (addition in the form of 17% Fe/Si); 0.8% Zn-stearate as lubricant Remainder: high purity atomised iron powder with a particle size mainly less than 100 mesh (147 μm).

Material B: 4.0% Si (addition in the form of 50% Fe/Si); 0.8% Zn-stearate as lubricant Remainder: high purity atomised iron powder with a particle size mainly less than 100 mesh (147 μm).

The compactability of these materials was tested at two compacting pressures, i.e. 4.2 ton/cm$^2$ and 6 ton/cm$^2$, and the following results obtained:

| | Compactability g/cm$^3$ | |
|---|---|---|
| | 4.2 ton/cm$^2$ | 6.0 ton/cm$^2$ |
| Material A | 6.35 | 6.64 |
| Material B | 6.54 | 6.83 |

Test bars were produced from these materials by compacting at 6 ton/cm$^2$ followed by sintering at 1250° C. for 30 minutes in hydrogen, the sintered density was thereafter determined:

| | Sintered Density g/cm$^3$ |
|---|---|
| Material A | 6.87 |
| Material B | 7.07 |

The Example clearly illustrates that a higher density i.e. lower porosity is reached when 50% Fe/Si is employed.

The establishment of the soft magnetic properties of the materials in question illustrates the superior qualities of material containing 50% Fe/Si when compared to those of material containing 17% Fe/Si. The soft magnetic properties are in line with those obtained for 31% Fe/Si as illustrated by the following table.

| | 17% Fe/Si | 31% Fe/Si | 50% Fe/Si |
|---|---|---|---|
| Coercive Force | 0.90 | 0.75 | 0.78 |
| Max. Permeability | 3100 | 3900 | 3800 |

To illustrate the relationship between particle size and compactability test bars were compacted as shown in the following example.

EXAMPLE 3

Two powder mixtures with nomenclature C and D were prepared.

Material C: 4.0% Si [addition in the form of 50% Fe/Si with a particle size less than 100 mesh (147% μm)]; 0.8% Zn-stearate as lubricant Remainder: high purity atomised iron powder with a particle size mainly less than 100 mesh (147 μm).

Material D: 4.0% Si [addition in the form of 50% Fe/Si with a particle size mainly less than 325 mesh (44 μm)]; 0.8% Zn-stearate as lubricant Remainder: high purity atomised iron powder with a particle size mainly less than 100 mesh (147 μm)

Compressibility for the two materials was determined at two compacting pressures, 4.2 ton/cm$^2$ and 6.0 ton/cm$^2$. The following results were obtained.

| | Compactability g/cm$^3$ | |
|---|---|---|
| | 4.2 ton/cm$^2$ | 6.0 ton/cm$^2$ |
| Material C | 6.54 | 6.83 |
| Material D | 6.47 | 6.79 |

This example illustrates the influence particle size of the silicon containing alloy powder has on the compactability. The achievement of high density is dictated by the use of ferrosilicon powder with a particle size less than 147 μm.

We claim:

1. A silicon containing iron powder for the production of sintered soft magnetic parts with low tool-wear required for production of said parts, comprising a high purity atomised iron powder with a particle size less than 147 μm with good compactability in which is intimately mixed a high purity atomised ferrosilicon powder with a particle size less than 147 μm in such proportions that the level of silicon content is less than 8%, said ferrosilicon powder having a silicon content of between 45 and 55%.

2. A silicon containing iron powder according to claim 1, in which the ferrosilicon powder has a silicon content of about 50%.

3. A powder for the manufacture of soft magnetic components comprising a mixture of:

(i) a high purity atomised iron powder having a particle size less than 147 μm; and (ii) a high purity atomised ferrosilicon powder having a particle size less than 147 μm and having a silicon content of between about 45 and 55%, said mixture having a total silicon content of less than about 8%.

* * * * *